United States Patent [19]

Weiler, Jr.

[11] 4,026,255

[45] May 31, 1977

[54] VEHICLE ENGINE SIGNAL DEVICE

[76] Inventor: Charles A. Weiler, Jr., 2711 Jossman, Holly, Mich. 48442

[22] Filed: Jan. 9, 1976

[21] Appl. No.: 647,702

[52] U.S. Cl. ..... 123/103 E; 123/103 R; 180/108; 180/109

[51] Int. Cl.[2] ..... F02D 11/08

[58] Field of Search ..... 123/103 R, 103 C, 103 E; 180/108, 109; 74/513

[56] References Cited

UNITED STATES PATENTS

| | | | |
|---|---|---|---|
| 2,148,729 | 2/1939 | Coffey | 123/103 E |
| 2,519,859 | 8/1950 | Teetor | 123/103 E |
| 2,692,980 | 10/1954 | Platt | 123/103 E |
| 2,825,418 | 3/1958 | Kershman | 123/103 E |
| 3,158,141 | 11/1964 | Harris | 123/103 R |
| 3,388,765 | 6/1968 | Sheppard | 180/108 |
| 3,958,542 | 5/1976 | Tanner | 123/103 E |

*Primary Examiner*—Wendell E. Burns
*Assistant Examiner*—William Randolph
*Attorney, Agent, or Firm*—Andrew R. Basile

[57] ABSTRACT

In an internal combustion engine of an automotive vehicle of the type having a carburetor which is operated by an accelerator pedal attached to the carburetor throttle valve by suitable linkage, a system is provided for comparing the actual intake manifold pressure to a predetermined intake manifold pressure setting. Means are provided for signaling the vehicle driver when the absolute intake manifold pressure increases above the predetermined setting for the desired operating condition to permit the driver to operate the vehicle in an optimum fuel-saving manner. The system comprises a control mechanism which senses intake vacuum and compares it to a predetermined intake manifold absolute pressure. The control mechanism is operable upon an increase in the intake manifold absolute pressure above the predetermined setting to operate an actuator mechanism that is connected to the throttle linkage for exerting a force which resists the opening of the carburetor throttle valve and signals the vehicle driver through a return force in the accelerator pedal that the driver is operating the engine in an uneconomical manner.

2 Claims, 4 Drawing Figures

VEHICLE ENGINE SIGNAL DEVICE

BACKGROUND OF THE INVENTION

I. Field of the Invention

The present invention relates to a signal device for use in automotive vehicles and, more particularly, to a device for providing a signal to the driver of the automotive vehicle in instances where the driver is operating the vehicle engine in an uneconomical manner.

II. Description of the Prior Art

When the load on the engine of an automotive vehicle is increased, for example, when the automotive vehicle is being driven up an incline, the vehicle driver normally depresses the accelerator foot pedal to maintain the speed of the vehicle. It is quite common that the vehicle operator will depress the accelerator foot pedal quickly under such circumstances. During this interval of speed increase the intake manifold suction decreases (that is, absolute pressure rises), and thus a rapid depression of the accelerator foot pedal to increase the fuel supply will result in an uneconomical fuel consumption and, thus, inefficient operation of the automotive vehicle engine. High engine intake manifold vacuum levels (low absolute pressure) at any given speed are necessary for good fuel economy, while low engine intake manifold levels (high absolute pressure) may be necessary for good engine performance but will necessarily result in reduced fuel economy. By maintaining the engine manifold vacuum constantly at higher levels (low absolute pressure) throughout the normal driving range, it is possible to operate an internal combustion engine at lower fuel consumption rates. In designing a system for combating the situations which result in poor fuel economy, it is important to take into consideration the poor driving techniques which generate low intake vacuum conditions and thereby result in reduced fuel economy. These techniques include the following:

a. Continuous pumping of a gas pedal while the vehicle is in a forward motion which results in numerous up-and-down changes in the vehicle speed per mile.

b. Rapid accelerations from a standing start.

c. Climbing hills or grades at increasing speeds, as indicated hereinabove.

d. Unnecessary high speed driving.

Various techniques and apparatuses have been employed in the past for providing improved systems for obtaining fuel economy in automotive vehicle engines. These systems recognize that, in the operation of an internal combustion engine of an automotive vehicle, the optimum fuel economy for any particular speed is achieved when the manifold vacuum of the engine is maintained at or above a certain level corresponding to that required to maintain that speed when the vehicle is operating on a level road. A decrease in the manifold vacuum level results in an increase in the density of the air-fuel mixture and, therefore, an increase in fuel consumption. When the operator of the vehicle presses down on the accelerator, the throttle valve of a carburetor is opened to permit a greater mass flow rate of the fuel-air mixture to the engine. This increase in the flow of the fuel-air mixture is attained with a corresponding decrease in vacuum in the engine manifold. Such a decrease in the manifold vacuum beyond the level needed to power the engine results in a higher fuel-air density and, therefore, in less fuel economy. A poor fuel economy often occurs as a result of the careless and unnecessary heavy acceleration, as described in the four examples hereinbefore mentioned. The prior art has attempted to alleviate these problems by providing systems and apparatuses which will maintain a substantially constant manifold vacuum in an automotive internal combustion engine in order to obtain optimum fuel performance or economy. These systems, while apparently operating in a satisfactory manner, tend to be complicated and costly, as they attempt to provide the desired result irrespective of the vehicle operator's operating habits. Examples of prior art apparatuses, devices, and systems which have been employed to overcome the aforementioned difficulties are disclosed in U.S. Pat. Nos. 2,148,729; 2,519,859; 2,825,418; 3,023,828; 3,158,141; and 3,250,261. While each of these patents discloses a system which provides a partial solution for the aforementioned problems, it is believed that applicant's invention discloses a new and improved system which will provide a signal to a driver in instances where he is depressing the accelerator of his vehicle more than is necessary or in too rapid a fashion to result in efficient operation of the vehicle, such that the operator may take the necessary steps to operate his vehicle in an optimum manner.

SUMMARY OF THE INVENTION

The present invention, which will be described subsequently in greater detail, comprises a fuel economizing system for particular adaptation to internal combustion engines of automotive vehicles. The system comprises a control mechanism which is responsive to a drop in the vacuum at the intake manifold of the internal combustion engine. Response is in the form of a vacuum signal to an actuator mechanism. The vacuum signal generates an actuator output force which tends to shift the throttle linkage in a direction partially closing the carburetor throttle valve. This action generates a force signal which is transmitted to the vehicle driver as an upward force on the accelerator pedal to inform the vehicle operator that he is operating the engine in an uneconomical manner.

It is therefore an object of the present invention to provide a new and improved system for fuel economy in an automotive engine.

It is another object of the present invention to provide a system having means for effectively signaling the vehicle operator in instances where the operator is depressing the vehicle accelerator more than is necessary or in too rapid a fashion for efficient operation of the vehicle.

It is a further object of the present invention to provide a system which continually senses the manifold vacuum of an internal combustion engine and functions to provide a signal to the vehicle operator when the manifold vacuum is caused to drop below a predetermined value, whereby the engine manifold vacuum may be maintained consistently at higher levels through the normal driving range in order to achieve optimum fuel economy.

It is still a further object of the present invention to provide a fuel economy system of the above-mentioned character which is simple in construction so that it may be manufactured for sale to the public at low cost; and, still further, it may be easily and quickly installed by the car owner.

Other objects, advantages, and applications of the present invention will become apparent to those skilled in the art of fuel-saving devices and systems when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and in which.

DESCRIPTION OF THE PREFERRED EMBODIMENT

Figure 1:
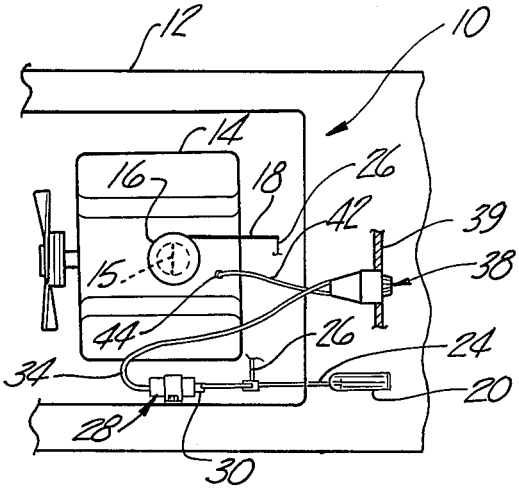
FIG. 1 is a top plan view of a fuel economy system constructed in accordance with the principles of the present invention and mounted in proximity to a conventional internal combustion engine of an automotive vehicle.

Referring now to the drawing and, in particular, to FIG. 1 wherein there is illustrated one example of the present invention in the form of a fuel economy system 10 mounted to a conventional automotive vehicle 12. The vehicle 12 has an internal combustion engine 14 including a conventional carburetor 16 having a throttle valve and/or valves 15 mounted at the throat of the carburetor in the conventional manner. A lever-linkage arrangement 18 is fixed on the end of the throttle valve shaft for effecting rotation of the shaft and, thus, the throttle valve 15, again in the conventional manner. A conventional accelerator foot pedal 20 is pivotally mounted on by hinge 22 so that the pedal 20 may be depressed by the operator's foot to increase the output power of the engine and is connected to lever linkage 18 by suitable linkage 24. The linkage 24 is pivotable about shaft 26 such that depression of the accelerator pedal 20 will rotate the linkage 24 in a clockwise direction (as viewed in FIG. 2) to cause the carburetor throttle valve 15 to increase its opening, while a decrease in the depression of the foot pedal 20 results in the rotation of the linkage 24 in a counterclockwise direction to decrease the opening of the carburetor throttle valve 15.

The fuel economy system 10 comprises an actuator mechanism 28 having a connecting rod 30 that is attached to the linkage 24 in such a manner that a commanded retraction of the actuator mechanism rod 30 will cause the accelerator linkage 24 to rotate counterclockwise about the pivot 26 to thereby decrease the opening of the carburetor throttle valve 15 and, at the same time, apply an upward force in the accelerator pedal 20 to provide a signal to the vehicle operator that he is operating the engine 14 in an uneconomical manner, as will be described in greater detail hereinafter. The actuator mechanism 28 has an outlet port 32 which is connected via conduit 34 to control port 36 of the control mechanism 38 which is mounted in a convenient location on the vehicle dashboard 39. The control mechanism, whose construction and operation will be described in greater detail hereinafter, includes a manifold sensing port 40 which is connected via a suitable conduit 42 to an intake manifold port 44 of the internal combustion engine 14.

As hereinbefore indicated, high engine intake manifold vacuum levels (low absolute pressure) at any given speed of the vehicle are necessary for good fuel economy, while low engine intake manifold vacuum levels (higher absolute pressure) are necessary for engine performance but will result in a reduced fuel economy. By maintaining the engine manifold vacuum constantly at the higher levels (low absolute pressures) throughout the normal driving range, it is possible to operate the internal combustion engine 14 at lower fuel consumption rates. The present invention accomplishes greater fuel economy by maintaining the engine loading relatively constant throughout its operation by means of monitoring the intake manifold pressure and signaling the vehicle operator through an opposing force directed through the accelerator pedal 20 when a preset engine load level has been exceeded, all of which will be described in greater detail hereinafter.

The control mechanism 38 comprises a housing 50 having a step bore 52 and a cover 54 having a step bore 56. The housing 50 and the cover 54 are attached to each other such that the step bores 52 and 56 are aligned, and the abutting faces of the housing 50 and cover 54 sandwich thereinbetween a diaphragm 58 to define pressure chambers 60 and 62 on opposite sides of the diaphragm 58. The cover 54 is secured to the housing 50 by a plurality of fastening members, such as threaded screw 64, which extends through a longitudinal bore 66 in the cover 54 and into threaded engagement with an aligned threaded bore 68 located in the abutting face of the housing 50.

The housing 50 has a longitudinal bore 70 into which is slidably disposed a plunger 72, the end of which abuts a valve member 74 such as to seat the same in a fluid-sealing manner against valve seat 76 to close fluid communication between the control port 36 and the manifold sensing port 40. The manifold sensing port 40 communicates with the pressure chamber 60 by means of longitudinal passageway 78. The valve chamber area 71 communicates with the passageway 78 by means of transverse passage 80 which is formed by a drilled hole and closed by plug 84. The longitudinal bore terminates at shoulder 86 which supports one end of a compression spring 88, the other end of which bears against the left wall of the diaphragm 58 so as to urge the diaphragm 58 to the right, as viewed in FIG. 3.

The step bore 56 is threaded at 90 and is threadingly engaged by an adjusting screw 92 having a circular inner end that defines a seat 94 supporting a spring seat 96. The spring seat 96 has a circular aperture 98 which supports one end of a coil spring 100, the other end of which abuts the right wall of the diaphragm 58 to urge the diaphragm 58 into engagement with the projecting end 102 of the plunger 72, such that the plunger 72 is biased into engagement with the valve member 74 to maintain the same in a fluid-sealing engagement with valve seat 76, as aforementioned.

The cover 54 has a bore 104 within which is disposed a stop pin 106 engagable by a stop tab 107 carried by the adjusting screw 92, such that the amount of rotation of the adjusting screw 92 is limited by the abutment of the stop tab 107 with the stop pin 106. A sleeve 108 carried by the projecting end 110 of the adjusting screw 92 is sandwiched between the threaded portion of the adjusting screw 92 and a dial plate 112 which is secured to the outer face of the cover 54 by means of a plurality of screws 114 (only one of which is shown). The sleeve 108 functions as an anti-rattle device which produces a frictional drag on the adjusting screw 92. The projecting end 110 of the adjusting screw 92 mounts a knob 116, which will be described in greater detail hereinafter in conjunction with a more detailed description of the dial plate 112.

The cover 54 has a longitudinal bore 118 which communicates the right-hand pressure chamber 62 to atmospheric pressure at all times. It can thus be seen that the compound axial force generated by the spring 100 and the force due to the atmospheric pressure in the chamber 62 acting on the right side of the diaphragm 58 are additive and act to the left, as viewed in FIG. 3, to exert a force on the plunger 72 to thereby maintain the valve member 74 in a fluid-sealing engagement with the valve seat 76. The compound axial force generated by the spring 88 and the pressure in the left-hand pressure chamber 60 acting on the left-hand side of the diaphragm 58 are also additive and act to the right to oppose the compound axial force generated by the spring 100 and the pressure in the pressure chamber 62.

Figure 2:
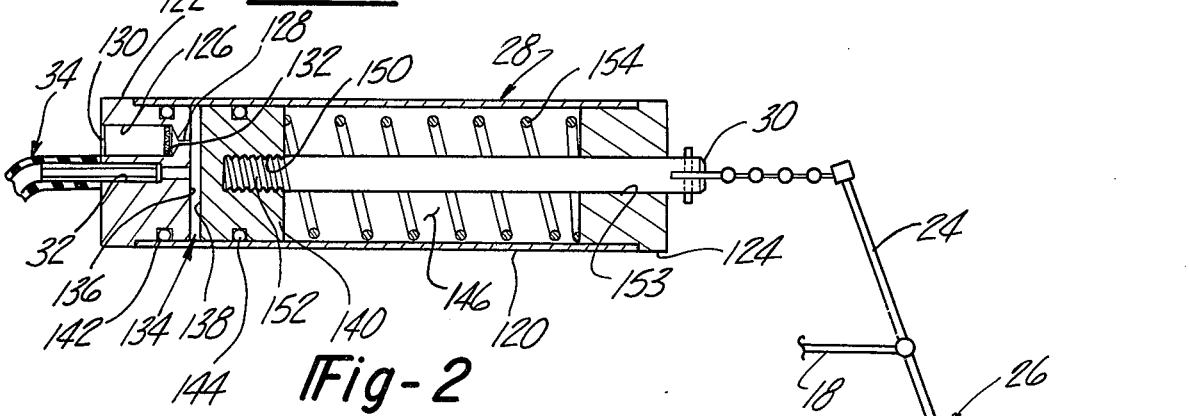
FIG. 2 is a longitudinal sectional view through an actuator mechanism that forms a part of the fuel economy system illustrated in FIG. 1.

Referring now to FIG. 2 for an aid in a detailed description of the actuator mechanism 28, it can be seen that the mechanism 28 comprises a tubular housing 120, the opposite ends of which are enclosed by caps 122 and 124. The cap 122 defines the outlet port 32 over which the conduit 34 is secured. Additionally, the cap 122 has a longitudinal bore 126 which is reduced in cross section at its inner end to define a restricted passageway that communicates with the interior of the tubular member 120. The restricted passageway defines a small bleed orifice 128 which is protected from contamination by a filter 130 and a filter screen 132 disposed within the bore 126 adjacent to the bleed orifice 128. The bleed orifice 128 admits atmospheric pressure to a pressure chamber 134 defined by the inner wall 136 of the cap 122 and the wall 138 of piston member 140 which is slidably mounted within the interior of the tubular housing 120. A static O-ring packing seal 142 provides a fluid tight seal at the juncture of the cap 122 and the tubular housing 120, while a dynamic O-ring 144 provides a fluid seal between the outer periphery of the piston 140 and the housing 120 so as to prevent fluid communication between the pressure chamber 134 and a pressure chamber 146 disposed between the piston 140 and the other end cap 124, yet the seal O-ring 144 permits linear motion of the piston 140 with respect to the housing 120. The right-hand side of the piston 140 has a threaded bore 150 which receives a threaded end 152 of the connecting rod 30 which, in turn, extends through a longitudinal bore 153 in the end cap 124 for connection to the carburetor linkage 24 in the aforementioned manner. It can be seen that, as the accelerator pedal 20 is returned to the lower power or reduced speed position, a spring 154 mounted within the pressure chamber 146 tends to move the piston 140 back to the left; that is, to reduce the size of the pressure chamber 134. A continuous atmospheric pressure level is maintained in the pressure chamber 146 by the annular opening defined by the connecting rod 30 loosely fitting the cap bore 153. It can thus be seen that atmospheric pressure flows into the chamber 134 through the bleed orifice 128 and is directed via the outlet port 32 and the conduit 34 to the control port 36 of the control mechanism 38 wherein it it blocked by the fluid-sealing engagement of the valve member 74 against the valve seat 76.

The system 10 is designed preferably to respond to and control engine intake manifold pressures between limits of 4 psia (22 inches of mercury vacuum) and 12 psia (5.5 inches of mercury vacuum). The control is infinitely variable between these limits. As viewed in FIG. 4, turning the selector knob 116 clockwise beyond the minimum setting turns the system off, permitting a full range of engine operation without incurring signal forces on the accelerator pedal 20, as will be described hereinafter. The "MAX" position on the dial plate 112 is designed to cause the control mechanism 38 to operate the actuator mechanism 28, if manifold vacuum drops below 22 inches of mercury level. The "AVG" or mid-position on the dial plate 112 is equal to approximatley 14 inches of mercury, while the "MIN" position is equivalent to approximately 5.5 inches of mercury.

In normal vehicle operation during which times the control mechanism 38 is non-operative and subsequently the accelerator pedal 20 is depressed, the linkage 24 is rotated clockwise, as viewed in FIG. 2, carrying the accelerator shaft 18 with it, all of which results in the opening of the carburetor throttle valve 15 increasing the air-fuel mass flow rate and, thus, increasing engine output power. This clockwise rotation of the linkage 24 pulls the connecting rod 30 and the piston 140 rightwardly against a small force generated by the actuator spring 154. As the accelerator pedal 20 is returned to the lower power or reduced speed positions, the accelerator spring 154 tends to move the piston 140 back to the left, decreasing the size of the pressure chamber 134. In a non-operative condition of the control mechanism 38 the piston 140 and the connecting rod 30 follow the movement of the linkage 18, as controlled by the vehicle operator, and adds only a very low additional force against the accelerator pedal 20, as detected by the driver.

Figure 3:
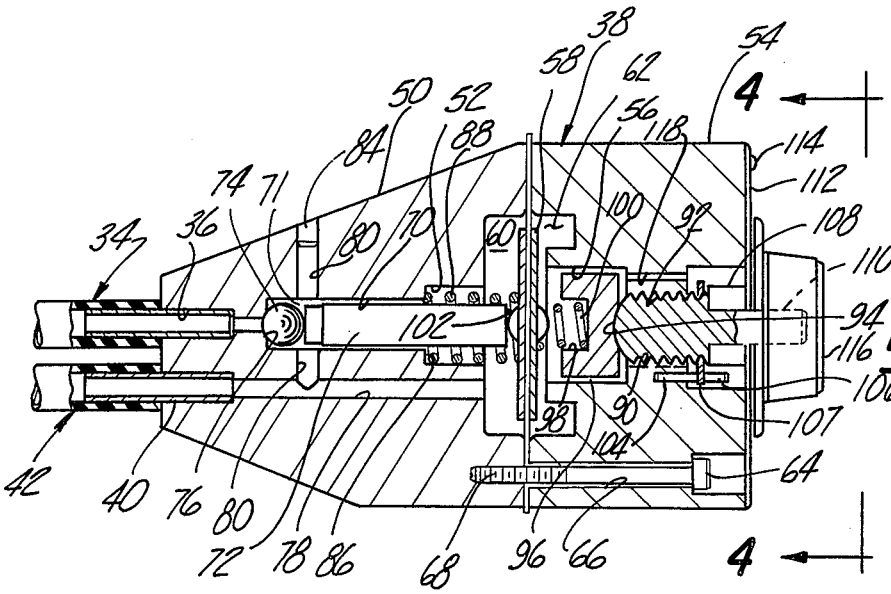
FIG. 3 is a longitudinal sectional view of the control mechanism which forms a part of the fuel economy system illustrated in FIG. 1.

When engine manifold vacuum is at or above the level selected by the vehicle operator by positioning the selector knob 116, the diaphragm 58 will be in the position shown in FIG. 3. The plunger 72 will maintain the valve member 74 seated on valve seat 76 blocking the passage of air from the actuator mechanism pressure chamber 134. In this condition the control actuator pressure in both chambers 134 and 146 is at ambient atmospheric level and is directed to the control port 36 via the conduit 34 but is blocked by the engagement of the valve members 74 with the valve seat 76.

When the engine manifold vacuum is below the level selected by the vehicle operator, the opposing forces on the diaphragm 58 become unbalanced; and the diaphragm 58 moves to the right, as viewed in FIG. 3. This motion unloads the plunger 72 causing the valve member 74 to unseat from the valve seat 76, allowing the atmospheric pressure level in the chamber 134 of the actuator mechanism 28 to exhaust to the lower pressure level in the passage 78 via the transverse passage 80. Since the bleed orifice 128 is small in area compared to the opening port area at the valve seat 76 when the valve member 74 is unseated, the pressure in chamber 134 will drop below atmospheric level. The resulting pressure differential across the actuator piston 140 produces a net force tending to push the piston 140 to the left, as viewed in FIG. 2. This force is communicated to the linkage 24 and tends to pull the linkage 24 in a counterclockwise direction, as viewed in FIG. 2, resulting in a movement of the linkage 18 in such a manner as to partially close the throttle valve position on the carburetor 16. This leftwardly directed force is felt as an upward force on the driver's foot through the accelerator pedal 20. When the driver senses the upward force, he should reduce the amount of accelerator loading; and, in so doing, the resulting reduction in the engine demand causes the vacuum level in the intake manifold to rise. This vacuum increase restores the force balance on the diaphragm assembly 58 causing it to move to the left against the plunger 72 to reseat the valve member 74 on valve seat 76 to block further communication of the air flow from the chamber 134 of actuator mechanism 28. Pressure equalization through bleed orifice 128 causes the actuator output force to return to zero, resulting in the cancellation of the force felt by the vehicle operator through the accelerator pedal 20.

If the driver elects to discount the signal force he receives through the accelerator pedal 20, he may maintain the existing speed or even increase it; but the signal force on the accelerator pedal 20 will require an additional effort in order to depress it.

It should thus be noted that the present fuel economizing system 10 is intended to notify the driver when a non-economical engine operating condition exists, but will not prevent operation in this range for necessary passing in traffic, acceleration, etc. The higher accelerator pedal force would continue until such time as engine loading is reduced to the equivalent vacuum setting as selected on the control dial plate 112 or until the setting is changed to a higher equivalent engine load rating. The higher load range results in lower manifold vacuum levels so, in effect, setting the control selector away from the "MAX" position toward the "MIN" position on the dial plate 112 and allowing lesser manifold vacuum levels before an unbalancing of the diaphragm assembly 58 occurs.

It should be noted that when the engine manifold vacuum chamber 60 is at or above the level selected on the dial plate 112, the result of the compound forces described above acts to the left causing the diaphragm 58 to continue to contact the plunger 72 which, in turn, maintains the valve member 74 seated on the valve seat 76; and, thus, no signal will be felt at the accelerator pedal 20. If the absolute pressure in chamber 60 rises (engine manifold vacuum drops), the resultant of the compound forces changes direction and acts to the right, as viewed in FIG. 3. This condition will unload the diaphragm permitting the plunger 72 to move to the right and, thus, resulting in the unseating of the valve member 74 from the valve seat 76. As the valve seat 76 is opened, air flow through the port 36 across the seat 76 to the lower pressure levels in the passageway 78 causes a corresponding reduction of pressure level in the actuator chamber 134. Atmospheric pressure in the actuator chamber 146 causes the piston 140 to move to the left toward the low pressure side of the actuator mechanism 28. This movement generates the pull force on the linkage 24 which tends to return the carburetor throttle valve 15 to the lower engine load-speed position and also signals the driver through the increase force felt at the accelerator pedal 20, as described hereinbefore.

Figure 4:
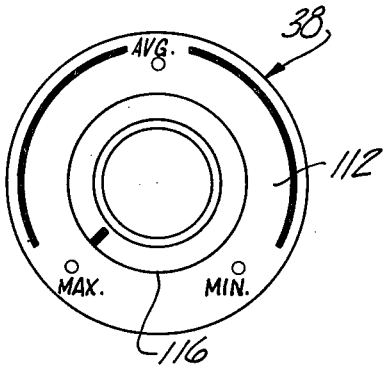
FIG. 4 is a front plan view of the control mechanism as seen from Line 4—4 of FIG. 3.

Knob 116 is used to control the position of the adjusting screw 92 and permits an increase in the loading of the spring 100 by rotating the knob 116 clockwise, as viewed in FIG. 4, which results in the inward movement of the adjusting screw 92. The resulting increased spring load of spring 100 (to the left) causes an increase in the load acting on the valve member 74 and, thus, more firmly blocks any flow across valve seat 76. Under this new, higher setting the absolute pressure in the chamber 60 will have to increase a set amount (the engine manifold vacuum must lessen) before permitting diaphragm movement to the right which would unload the valve 74 and allow air to cross over the valve seat 76 from the actuator mechanism chamber 134. Conversely, when the force attributed by the spring 100 is reduced by a change in the adjusting screw 92, that is, by rotating the knob counterclockwise, as viewed in FIG. 4, an unbalance in the diaphragm forces results. The diaphragm then moves to the right unseating the valve member 74 such that air will flow across the valve seat 76 to reduce the pressure level in the actuator mechanism chamber 134, and the aforementioned accelerator linkage control is effected. A cancellation of the above effect can be made by the driver by reducing the accelerator loading a small amount. This change in accelerator loading will result in an increase in manifold vacuum (the lowering of the absolute pressure), and such an increased manifold vacuum level in chamber 60 will again shift the plunger 72 leftwardly to load the valve member 74 against the seat 76; and the accelerator pedal signal force will then drop to zero.

From the foregoing it is apparent that the invention as described herein provides an efficient mechanism which may be manufactured simply and inexpensively and which will serve to effectively transmit a signal to the driver of an automotive vehicle should he be driving the same in a manner which results in uneconomical fuel consumption and inefficient operation of the vehicle.

It should be understood by those skilled in the art of fuel economy control devices that other forms of the present invention may be had, all coming within the spirit of the invention and scope of the appended claims.

What is claimed is as follows:

1. In an internal combustion engine of a vehicle having a carburetor, a manually operated accelerator pedal controlling the opening of a carburetor throttle valve, and an intake manifold, a system for comparing the actual intake manifold pressure to a predetermined intake manifold pressure setting and signaling the vehicle driver when the absolute intake manifold pressure increases above said predetermined setting, said system comprising:

a control mechanism having a pressure responsive movable wall;

first means for generating a force resisting movement of said wall in a first direction, said force being a function of said predetermined intake manifold pressure setting;

second means communicating said intake manifold pressure to said pressure responsive wall for generating a second force acting on said movable wall and opposing said first-mentioned force for moving said wall when said manifold pressure exceeds said predetermined setting;

actuator means having a bore;

piston means movably mounted within said bore dividing same into first and second pressure chambers, said piston being connected to said accelerator pedal and movable in a first direction to decrease the opening of said throttle valve, one of said pressure chambers communicating with atmospheric pressure for generating a force on said piston to move said piston in said first direction; and valve means operable upon movement of said wall for communicating said other pressure chamber to said intake manifold pressure whereby said piston means is moved in said first direction due to the pressure differential thereacross.

2. The system defined in claim 1 wherein said predetermined intake manifold pressure is selectively variable.

* * * * *